US009422101B2

(12) United States Patent
Wu et al.

(10) Patent No.: US 9,422,101 B2
(45) Date of Patent: Aug. 23, 2016

(54) BLISTER PACKAGE WITH COMPARTMENTS

(71) Applicant: MeadWestvaco Corporation, Richmond, VA (US)

(72) Inventors: Meng-Chuan Wu, Richmond, VA (US); Charlotte Hanks, Toronto (CA); Alyssa Smith, Quinton, VA (US)

(73) Assignee: WestRock MWV, LLC, Norcross, GA (US)

( * ) Notice: Subject to any disclaimer, the term of this patent is extended or adjusted under 35 U.S.C. 154(b) by 782 days.

(21) Appl. No.: 13/785,326

(22) Filed: Mar. 5, 2013

(65) Prior Publication Data

US 2013/0228488 A1 Sep. 5, 2013

Related U.S. Application Data

(60) Provisional application No. 61/606,676, filed on Mar. 5, 2012, provisional application No. 61/606,723, filed on Mar. 5, 2012.

(51) Int. Cl.
*B65D 83/04* (2006.01)
*B65D 73/00* (2006.01)

(52) U.S. Cl.
CPC ..... *B65D 83/04* (2013.01); *B65D 73/0092* (2013.01)

(58) Field of Classification Search
CPC .. B65D 41/06; B65D 43/0225; B65D 50/043; B65D 75/327; B65D 75/36; B65D 75/366–75/367; B65D 77/02; B65D 77/0433; B65D 83/02; B65D 83/04; B65D 83/0445; B65D 83/0454; B65D 83/0463; B65D 85/04; B65D 85/36; B65D 2543/00092; B65D 2543/00296; B65D 2543/00351; B65D 2543/00518; B65D 2543/00555; B65D 2543/00574; H01M 2/1038; H01M 2/1044; H01M 12/06; Y02W 30/807; A24F 23/00; A61J 1/035; A61J 7/04
USPC ..... 206/303, 398, 389, 461, 462, 471; 220/4.21, 253, 293, 298, 300–301, 220/326, 507, 524, 635, 821; 221/1, 4–5, 221/13, 25, 69, 82–83, 86–87, 89–91, 122, 221/132–133, 154, 277; D3/203.3
See application file for complete search history.

(56) References Cited

U.S. PATENT DOCUMENTS

| | | | | |
|---|---|---|---|---|
| 1,816,542 | A * | 7/1931 | Mellin | B65D 73/0092 206/463 |
| 2,796,985 | A | 6/1957 | Gorton | |
| 3,044,618 | A | 7/1962 | Surloff | |
| 3,178,019 | A | 4/1965 | Fetzek | |
| 3,581,885 | A | 6/1971 | Wald | |

(Continued)

FOREIGN PATENT DOCUMENTS

| | | | |
|---|---|---|---|
| DE | 9303242 | U1 | 7/1994 |
| DE | 20120503 | U1 | 4/2003 |

(Continued)

*Primary Examiner* — J. Gregory Pickett
*Assistant Examiner* — Brijesh V. Patel
(74) *Attorney, Agent, or Firm* — WestRock Intellectual Property Group

(57) ABSTRACT

A package is disclosed comprising an outer blister portion and an inner blister portion, each blister portion having a flange, the flanges enclosed between paperboard cards, arranged so that upon rotation of the outer blister portion access is obtained to compartments within the inner blister portion. The compartments may hold product items.

19 Claims, 7 Drawing Sheets

(56) References Cited

U.S. PATENT DOCUMENTS 3,604,559 A * 9/1971 McCall ..... B65D 83/0454 206/533
3,995,767 A * 12/1976 Brindley ..... B65D 83/02 206/704
4,078,661 A * 3/1978 Thomas ..... B65D 83/0454 206/533
4,124,143 A * 11/1978 Thomas ..... B65D 83/0463 206/534
4,270,659 A 6/1981 Kuchenbecker
4,705,163 A 11/1987 James
4,953,700 A * 9/1990 DeDino ..... B65D 73/0092 206/461
5,322,166 A * 6/1994 Crowther ..... B65D 83/0454 206/534
5,613,607 A 3/1997 Kalmanides et al.
5,888,565 A * 3/1999 Gics ..... B65D 77/0433 206/462
5,921,395 A * 7/1999 Alexander ..... B65D 83/0454 206/1.5
6,039,185 A * 3/2000 Pedracine ..... H01M 2/1038 206/469
6,615,986 B2 * 9/2003 Pirro ..... B65D 73/0092 206/459.5
6,659,281 B2 * 12/2003 Gaffney ..... B65D 83/0454 206/471
6,889,840 B2 5/2005 Schein et al.
6,991,110 B2 * 1/2006 Flynn ..... H01L 21/67386 206/533
7,144,635 B2 12/2006 Hawes et al.
7,147,127 B2 * 12/2006 Lepke ..... B65D 83/0454 221/4
7,513,369 B1 4/2009 Lee
7,543,718 B2 * 6/2009 Simon ..... A61J 7/0084 206/380
8,033,422 B2 * 10/2011 Estrada ..... B65D 50/04 221/154
2004/0182735 A1 9/2004 Lombardi et al.
2005/0205458 A1 * 9/2005 Pearson ..... B65D 83/04 206/538
2008/0029417 A1 * 2/2008 Begim ..... B65D 75/36 206/461
2008/0105587 A1 * 5/2008 Hawes ..... B32B 27/10 206/532
2009/0159479 A1 * 6/2009 Smith ..... B65D 75/366 206/461
2010/0170821 A1 7/2010 Grosskopf
2010/0219198 A1 * 9/2010 Goldman ..... B65D 83/0454 221/25
2012/0125796 A1 5/2012 Falcon
2012/0228177 A1 9/2012 Schwester
2012/0279098 A1 * 11/2012 Berenson ..... G09F 1/10 40/124.04
2013/0015197 A1 1/2013 Gauthier

FOREIGN PATENT DOCUMENTS

FR 1333755 A 8/1963
WO WO0187732 A1 11/2001
WO WO02/38470 A1 5/2002
WO WO2008154566 A1 12/2008
WO WO2011115762 A1 9/2011
WO WO2012067757 5/2012
WO WO2013028299 2/2013

* cited by examiner

FIG. 2A
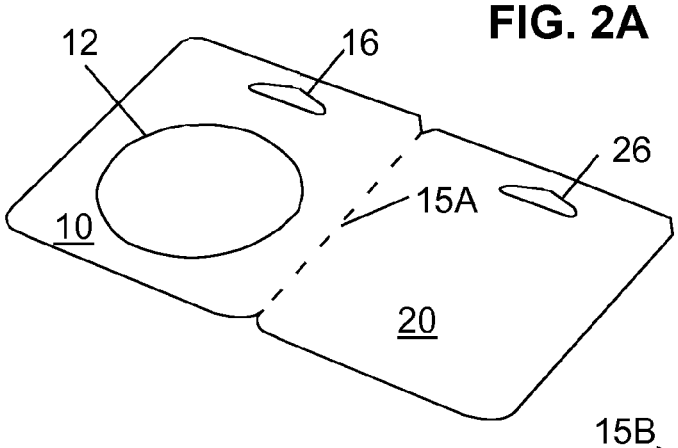
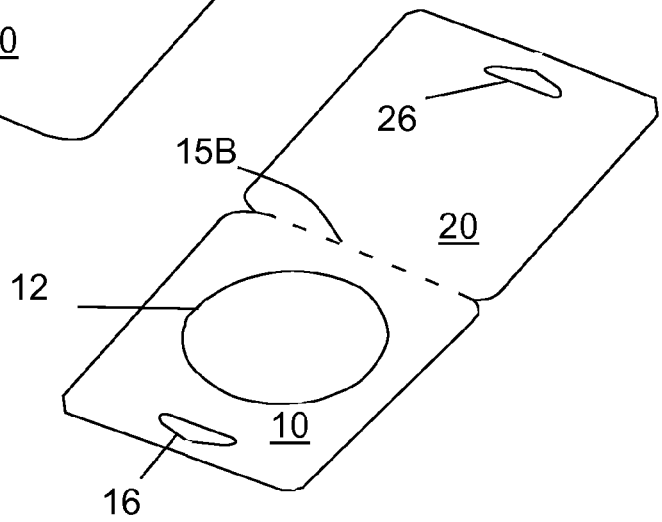
FIG. 2B
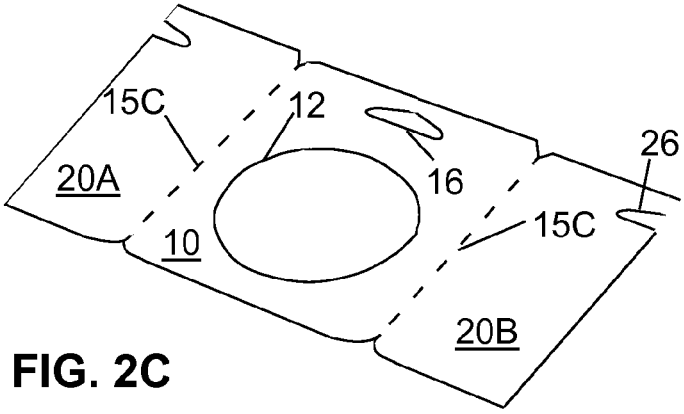
FIG. 2C

BLISTER PACKAGE WITH COMPARTMENTS

REFERENCE TO RELATED APPLICATION

This application claims the benefit of priority under 35 U.S.C. §119(e) of U.S. provisional application Ser. No. 61/606,676 filed on Mar. 5, 2012, and Ser. No. 61/606,723 filed on Mar. 5, 2012, which are both hereby incorporated by reference in their respective entireties.

BACKGROUND

The present application is directed to paperboard packages and, more particularly, reclosable security packages with a twist-open feature.

Manufacturers and retailers of consumer goods, such as pharmaceuticals, software, electronics, health and beauty products and the like, typically package their products in tamper resistant security packages. For example, many consumer goods are packaged in blister or clamshell packages formed by positioning a consumer good in a flanged blister made from various polymeric and/or paperboard materials and sealing the flanged blister between two paperboard substrates. Consumers have voiced disapproval of such packages because of the difficulty of opening the same and the potential for being cut on a rough edge especially of plastic blisters. Packages may therefore be made based largely on paperboard, for example, NATRALOCK® packages. Packaging made primarily of paperboard is more sustainable than packaging made from petroleum-based plastics. The paperboard used in such packages may be tear-resistant as described in commonly assigned U.S. Pat. No. 7,144,635.

Some blister packages may comprise a paperboard card and a blister. Especially when made with tear resistant paperboard, these packages can be quite secure and may require a tool such as a scissors or knife to open the package. Thus the secure structure of the packages may prevent in-store theft and tampering. However, after purchase, when the package has been cut to remove the product, the user may wish to still use the package around the house for occasionally storing the product. Such might be the case if the product is a small tool that is used occasionally, but is otherwise most conveniently kept in the package, for example due to safety reasons such as with replacement blades for a utility knife, or due to product protection for example with small flashlight bulbs that are easily lost or broken, or for orderly product storage, for example with many hardware items such as bolts, screws, etc which become lost or commingled if not kept in a package. If a security package has been cut open, it often becomes unusable or difficult to use for future storage of the product. Furthermore, even an unwanted product is returned to the retailer, the package may be damaged enough so that the retailer cannot sell it again (e.g. as discounted returned goods). It would be advantageous therefore to have a security package which, after opening, could still be returned to a closed configuration for containing its contents. Even with a less-secure or non-secure package or non-secure package, it may be desired to have a structure that permits the package to be returned to a closed configuration after accessing its contents.

The current application discloses a blister package that may be opened by rotating the blister, and after being opened, may be reclosed also by rotating the blister. U.S. application Ser. No. 13/300,015 filed on Nov. 18, 2011 discloses a blister package including a rotating one-piece blister which can be reversibly removed or replaced into the package. The present Application discloses a two-piece blister including an inner stationary portion and an outer rotatable portion.

SUMMARY

In one aspect a package is disclosed which comprises a first card and a second card comprised of sheet material and partly sealed together, and a blister having one or more peripheral flanges trapped between the cards. The blister may include an inner blister portion that is stationary and an outer blister portion that may be rotated relative to the inner portion, to open or close the blister.

Other aspects of the disclosed packaging structures will become apparent from the following description and the accompanying drawings.

A reclosable feature is provided on a blister pack. The reclosable feature may allow consumers the ability to handle a product before purchase (i.e. to check sizing, texture, etc.), and may also allow the use of the package for storage of the product after purchase. In another embodiment for retail security packaging, a one time secure opening feature is provided which after opening acts as an indicator of an opened package, but the package is still reclosable. This initial one time security feature would meet the requirements of retail loss prevention groups for initial security packaging requirements. Having a reclosable feature allows the product to be repackaged for store returns, making the package and product able to be redisplayed as saleable merchandise.

A two piece case such as a thermoform blister may be used, which may fit between two cards or between the halves of a one-piece hinged card. However, case or "blister" as used herein is meant to also encompass container structures made by injection molding, stamping, pressing, and other methods. The blister peripheral portions may include flanges that may be trapped between two cards. An inner blister portion may include a flange that is sealed to one of the cards. An outer blister portion may include a flange that for the most part may lack any sealing to either card.

Using tear resistant board such as MeadWestvaco NATRALOCK® combined with the rotational blister closure may provide a retail security package with some degree of difficulty to open, which still after opening retains a neat appearance and is easily reclosed.

BRIEF DESCRIPTION OF THE DRAWINGS

FIGS. 2A, 2B, and 2C are perspective views of alternative forms of cards for forming a package;

DETAILED DESCRIPTION

Figure 1:
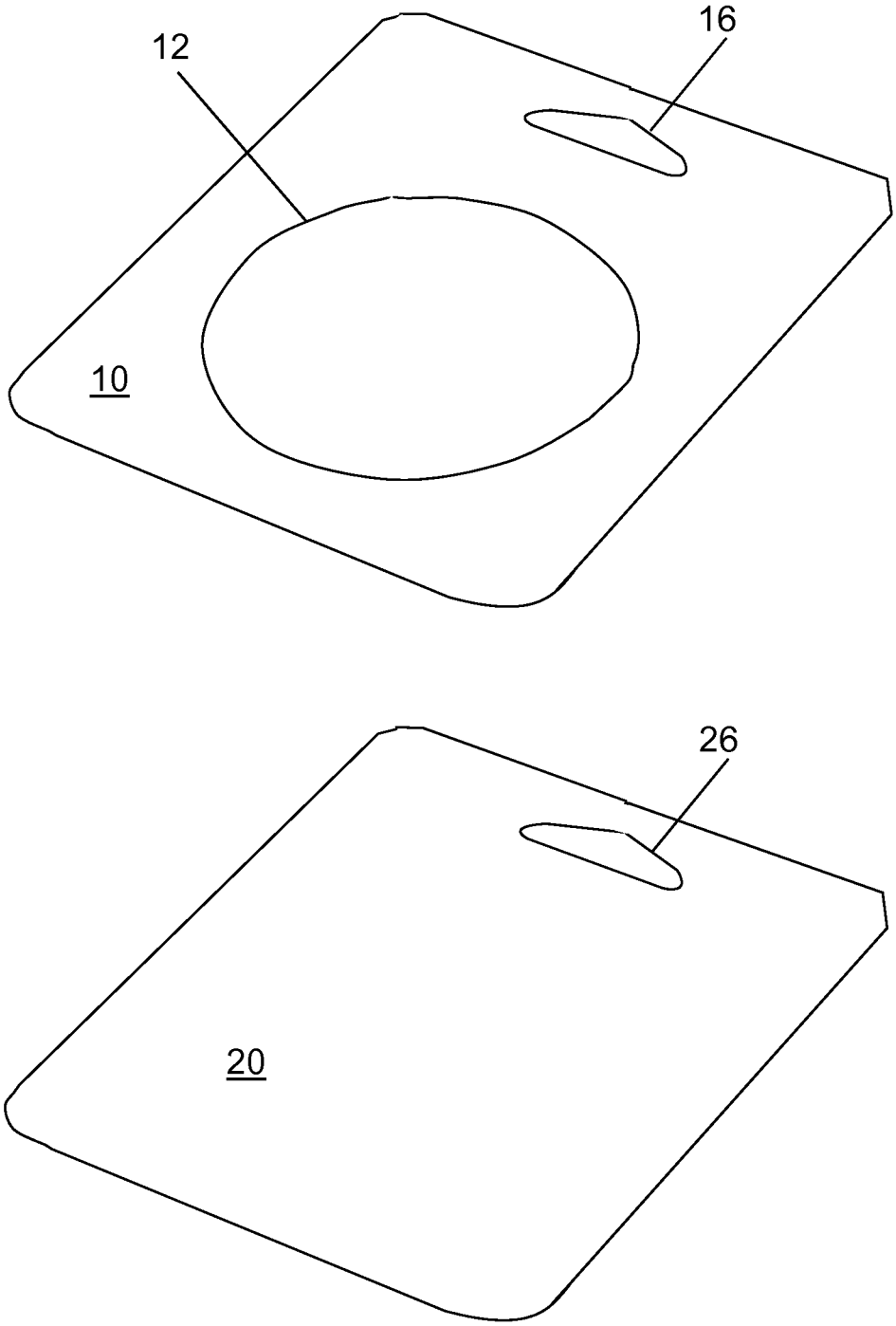
FIG. 1 is a perspective view of cards for forming a package.

As various embodiments of the security package are described, reference will be made to FIGS. 1-7. Certain parts of the packages are denoted by reference numerals. Where there is more than one of the same feature, sometimes only one will be denoted by a reference numeral. If different packages have a common feature, it may only be described one time. Typically in these Figures, solid lines show edges, while dashed lines show hidden or partially obscured features.

Where assembly steps are described, these steps are exemplary and are not to be limiting as to the sequence of operations used to arrive at the final package. Also, directions such as up, down, top, bottom, front, back, etc. are used for convenience in describing the package and are not meant to be limiting. In most cases the packages described here are made from one or several blanks (that is, the cut sheet parts from which the package components are made by folding and other steps). However, it should be understood that certain unitary blanks may be provided instead as more than one part, and certain blanks may be combined into single blanks, while still arriving at the same finished package.

This blister package disclosed here may be used to package multiple product units while allowing access to one unit at a time. The package may include a front and back paperboard cards (or a single folded over card) which traps an inner and outer blister. The inner blister may be sealed between the cards, and the outer blister allowed to move or rotate about the inner blister. An aperture may be cut into the outer blister which provides an opening for access to the contents in the inner blister. Moving or rotating the outer blister may align the opening with one or more cavities of the inner blister to allow access to the contents of the inner blister. The aperture of the outer blister may also be aligned with a raised surface portion of the inner blister to hold the package closed. The indentations on the sides of inner and outer blisters can align with each other and correspond to the products in the inner blister such that in specific periodic positions the aperture is properly aligned with the contents.

FIG. 1 shows a top perspective view of certain parts of a package, including a front card 10 and back card 20. An aperture 12 may be provided in the front card, to receive a case or blister as described below. The aperture may be circular or approximately circular. Hang holes 16, 26 may be provided on one or both cards.

Although front card 10 and back card 20 may be provided separately as shown in FIG. 1, they may also be provided as a single piece, for example, with the front card 10 and back card 20 joined along a hinge or fold line as shown in FIGS. 2A-2C. FIG. 2A shows the cards joined side-by-side along fold line 15A, while FIG. 2B shows the cards joined top-to-bottom along fold line 15B. The cards may be formed in subsections, such as in FIG. 2C where the back card is made of subsections 20A and 20B joined to the front card 10 along fold lines 15C. Other configurations are also possible for the cards.

The cards may be made of a sheet material such as paperboard, or of a tear-resistant paperboard such as MeadWestvaco NATRALOCK®. The cards may be similar in size and shape, for example both being rectangular as shown in FIGS. 1 and 2. The overall shape of the cards may be rectangular as shown, or any desired shape. The front and back cards may differ in size and shape, for example, the upper region of either card may be shorter than the upper region of the other card. This might be done for example to save material. If a hang hole is desired, a single ply hang hole may be sufficient and may be provided either as hang hole 16 in front card 10 (if the upper region of back card 20 is shortened), or hang hole 26 in back card 20 (if the upper region of front card 10 is shortened).

Figure 3:
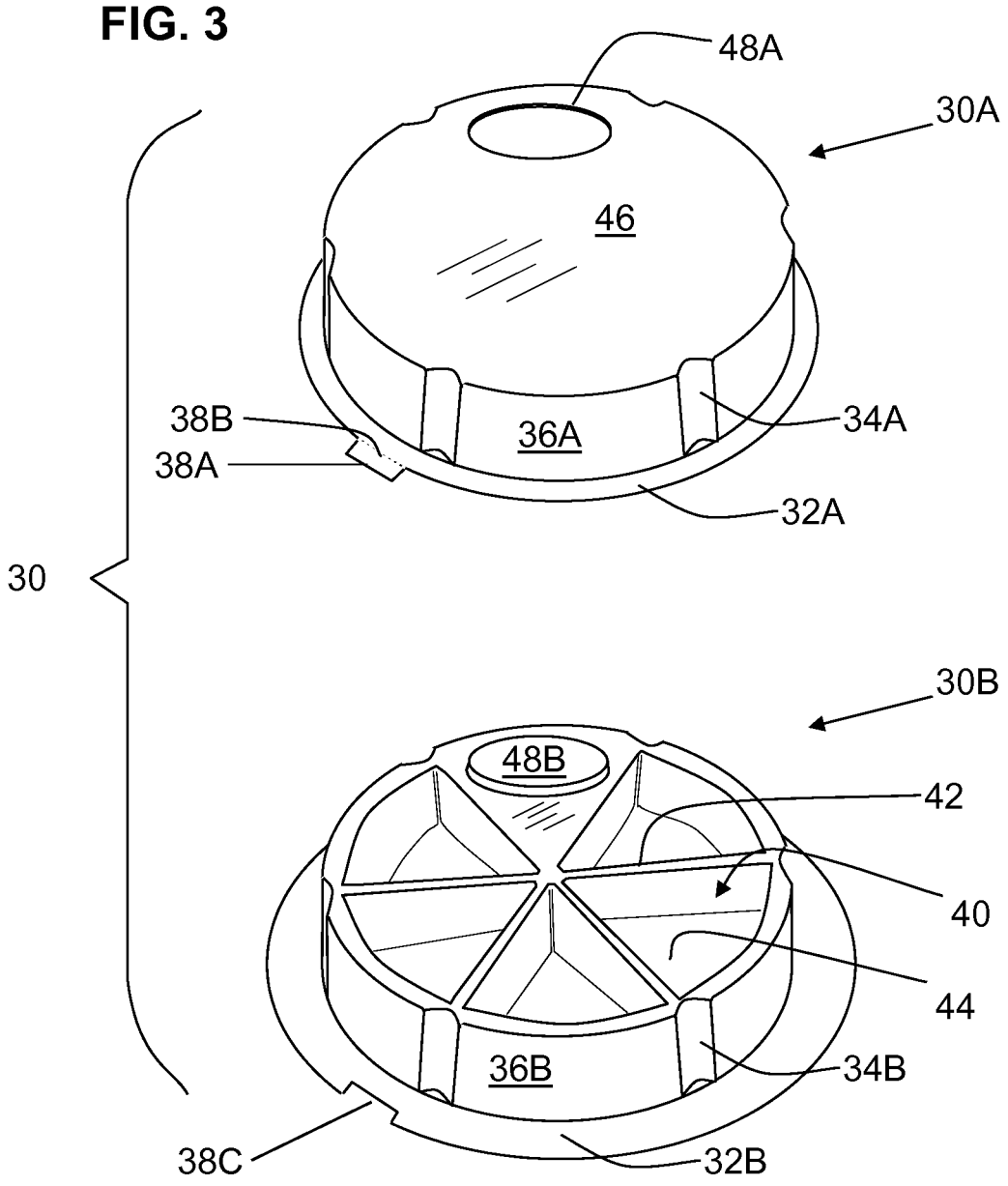
FIG. 3 is a perspective view of blister portions for forming the package.

Aperture 12 in front card 10 may receive a case or blister 30 shown in FIG. 3. The blister may include an outer blister 30A and inner blister 30B. For example, outer blister 30A and inner blister 30B may have a circular cylindrical shape including a side wall 36A, 36B. The inner blister 30B may be sized to fit within outer blister 30A. A close fit between the inner and outer blisters may be advantageous. The outer blister 30A may have an outer flange 32A that may be sandwiched between front card 10 and back card 20, without being sealed to either card, except for an optional lock tab 38A extending from outer flange 32A. A perforation or other weakness may be provided between the lock tab 38A and the outer flange 32A. Once the perforation 38B is broken, as a first step in opening the package, the outer blister 30A may then be free to rotate.

The inner blister 30B may have an inner flange 32B that may be sandwiched between front card 10 and back card 20, and sealed to one or both cards at least along portions of the flange, to hold the inner blister 30B stationary. The inner flange 32B may be large, e.g. have a larger diameter, than the outer flange 32A. In other words, inner flange 32B may extend further outward than outer flange 32A. A clearance notch 38C may be provided in the inner flange 32B, to align with the lock tab 38A. If adhesive, heat sealing, or other fastening is applied to the peripheral edge of inner flange 32B (to keep it stationary), but adhesive, heat sealing, etc. is not applied to the peripheral edge of outer flange 32A (to allow its rotation), then the lock tab 38A may extend into the sealed area and particularly into the clearance notch 38C (where the lock tab 38A may be sealed to temporarily prevent rotation of the outer blister 30A. Once the perforation 38B is broken, as a first step in opening the package, the lock tab 38A is then broken away from outer flange 32A, permitting outer blister 30A to rotate.

The walls 36A, 36B of the blisters may include detents 34A, 34B which may engage one another to stop the rotation of outer blister 30A at a number of preferred positions. For example, if there are five compartments within the package, and the detents may be positioned to stop the outer blister 30A rotation at each compartment. There may also be a sixth position, such as a 'closed' position where none of the compartments are open. This closed position may also be served by a detent or detents. As shown in FIG. 3, the detents 34A, 34B may take the form of partially cylindrical indentations or grooves into the walls 36A, 36B. However, the detents may have other shapes such as rectangular channels (see FIG. 4), or bumps (not shown) engaging depressions or holes formed in the walls 36A, 36B. Rather than having one detent for each compartment (and for the closed position), which form an intermittent engagement, the detents be smaller, more continuous shapes such as knurling or teeth (not shown) provided around part or all of the circumference of the walls 36A, 36B. Rather than having the detents in the walls of the blisters, the detents could also be provided on the top surfaces of the blisters. However, having detents on the walls also facilitates gripping the outer blister 30A in order to rotate it.

The inner blister 30B may include one or more compartments 40 for holding product items. The compartments may be delimited by compartment walls 42. The shape and size of the compartment walls, if used, may be determined by manufacturing preference. The compartments may have optional compartment floors 44. However, back card 20 may also serve as the floor of a compartment.

The outer blister 30A may include a top surface 46 which serves to close the compartments 40. However, an opening 48A may be provided in top surface 46 through which to access the compartments. An optional, complementary stop feature 48B may be provided in the inner blister 30B. The stop feature 48B may protrude slightly upward from the inner blister so that when the outer blister 30A is moved to a closed position, the stop feature 48B may move into or engage opening 48A to secure the package in the closed position. The opening 48A may be sized and shaped to permit passage of a product item stored within compartment 40. The stop feature 48B may be sized and shaped to fit into opening 48A.

Figure 4:
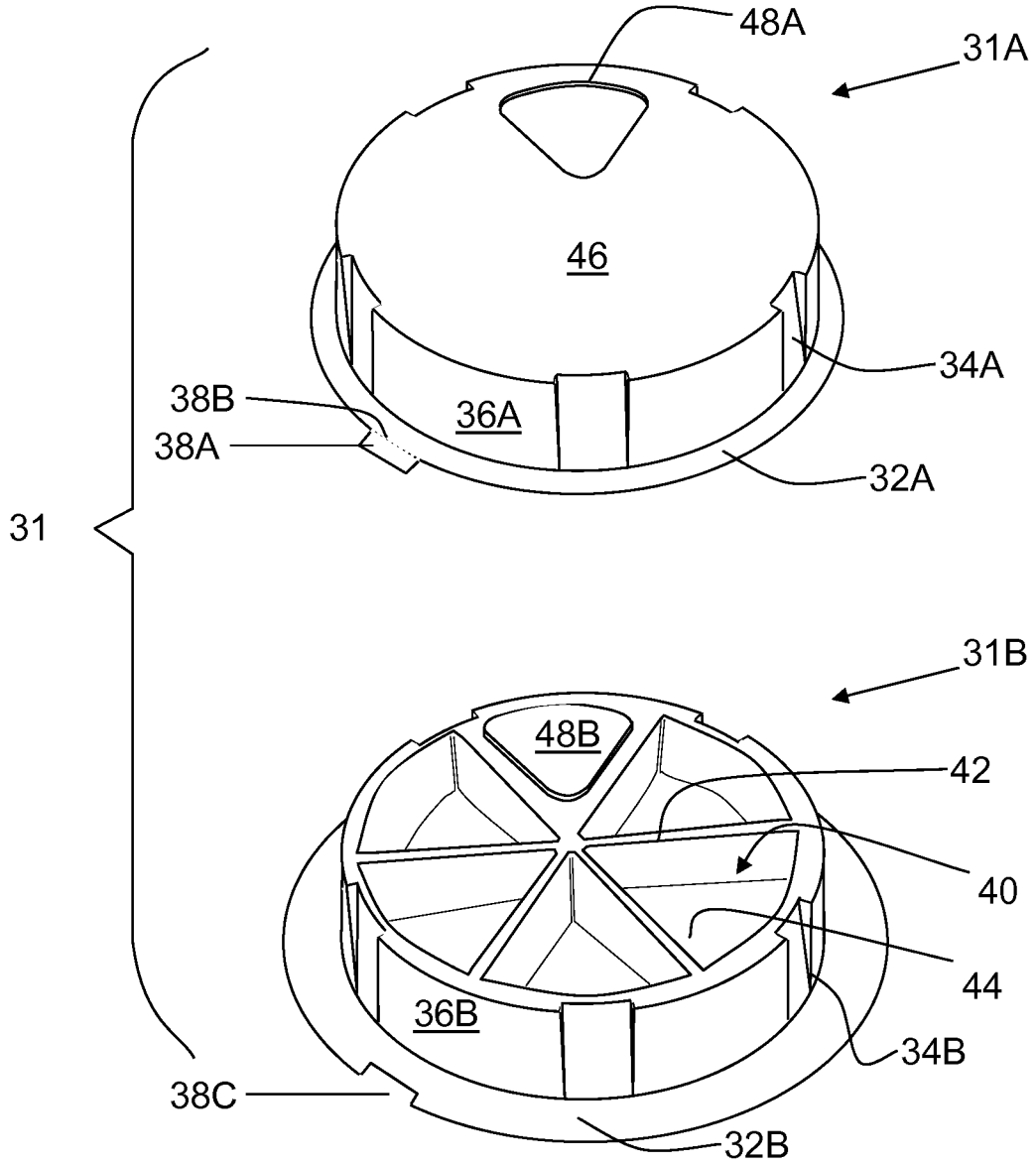
FIG. 4 is a perspective view of alternative blister portions for forming the package.

The blister may have a different shape from blister 30 shown in FIG. 3. For example, FIG. 4 shows a blister 31 with similar features in outer blister 31A, inner blister 31B, but with detents 34A, 34B having a rectangular channel shape, and opening 48A with stop feature 48B having a triangular shape.

It may be advantageous for the blister to have an approximately circular shape to allow the blister (and outer flange 32A) to rotate fairly easily. Approximately circular shapes, by way of example, could include polygons with about 12 or more sides. If the outer blister 30A and inner blister 30B fit closely, then an approximately circular shape will work well. If the outer blister 30A and inner blister 30B fit loosely, then non-circular shapes, such as polygons with fewer than about 12 sides, may also work.

Case or blister 30, 31 may be made with common thermoform plastics such as PVC or APET but may also include a recycled material such as RPET or a biodegradable material such as PLA. However other materials including other plastics or paperboard may also be used. Besides thermoforming, the case or blister may be formed by injection molding or other manufacturing methods.

Figure 5:
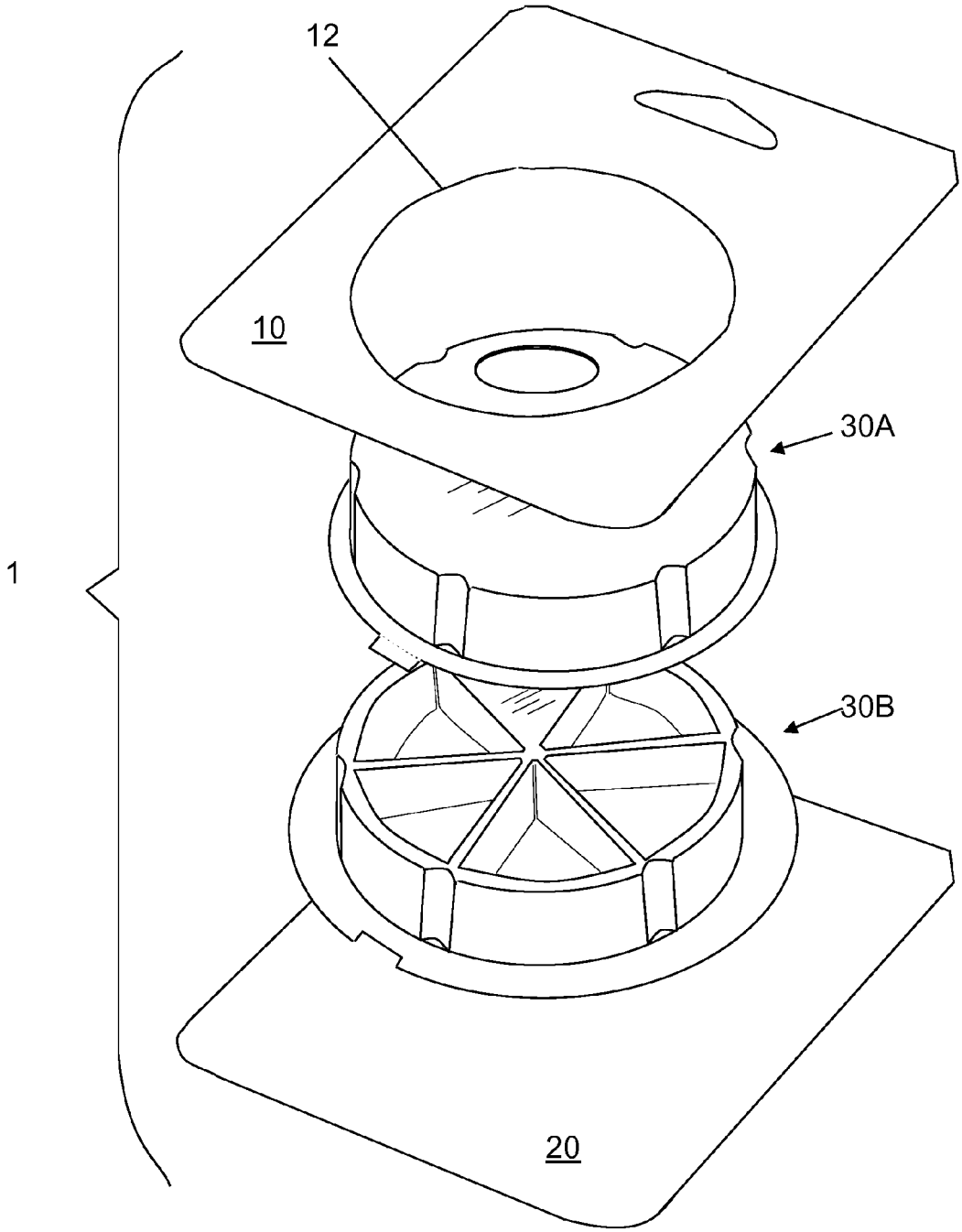
FIG. 5 is a perspective, exploded view of the cards of FIG. 1 and blister portions of FIG. 3, showing an assembly alignment.

Blister 30 may be sandwiched between front card 10 and back card 20 to form a securely closed package. FIG. 5 shows an exploded view of the outer blister 30A (to the front) and inner blister 30B (to the back) positioned between front card 10 and back card 20. Together the parts will make up package 1.

Figure 6:
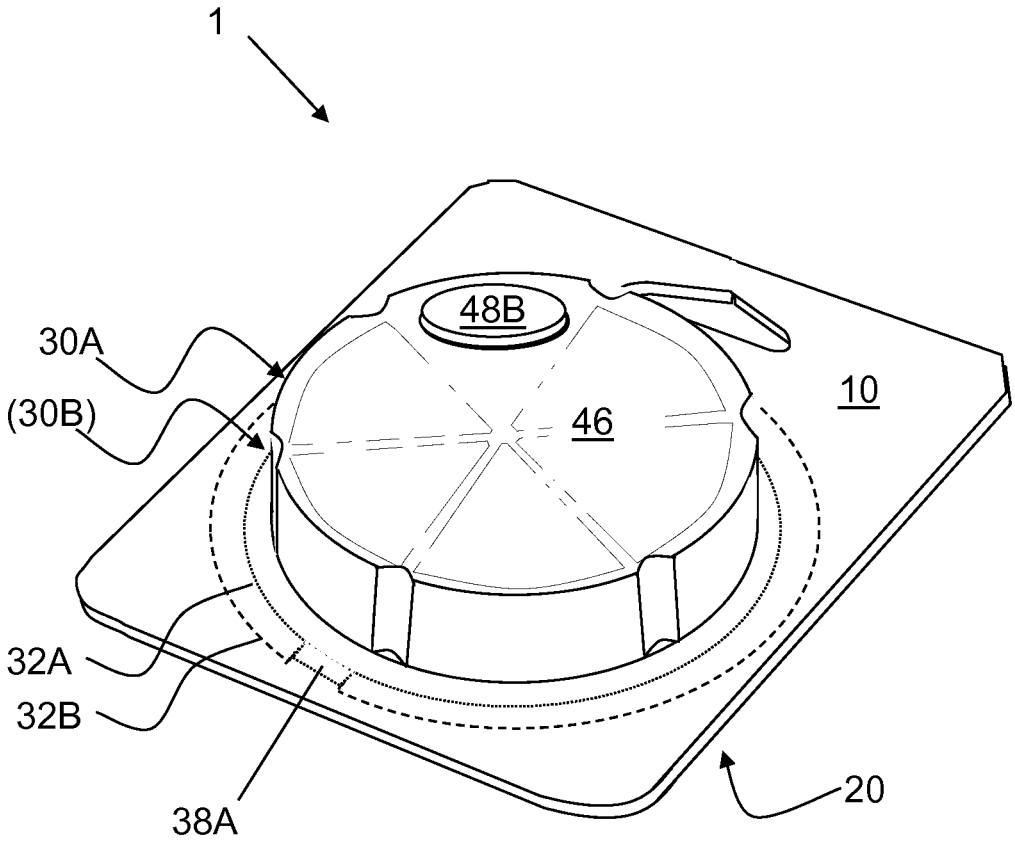
FIG. 6 is a perspective view of the finished package.

FIG. 6 shows the finished package 1 where the cards have been brought together with the blister flanges sandwiched between the cards. The now hidden outer flange 32A and inner flange 32B are shown in dashed lines. The cards may be joined together by heat sealing, RF (radio frequency) sealing, ultrasonic sealing, adhesive, or other means. Such sealing may be done on most of the facing surfaces of the front and back cards (except the vicinity of outer flange 32A as further described) or sealing may be done to less than the entire facing surfaces, for example only around the outer perimeter of the card, and along and outer perimeter of inner flange 32B (but generally not sealing outer flange 32A).

During shipping and handling, the lock tab 38A may be adhesively secured to at least one of the front and back cards (or it could be stapled in place). After purchase, a customer may twist the outer blister 30A in either direction with moderate force to break perforation 38B and free the outer blister to rotate. The user may then rotate the outer blister 30A relative to the (stationary) inner blister 30B in order to access the contents of compartments 40. The detents 34A, 34B may interact to pause rotation at each of the compartments. After the customer removes (or replaces) the contents out of/into a compartment, the outer blister 30A may be rotated back to the closed position where stop feature 48B may engage opening 48A to hold the package closed.

Figure 7:
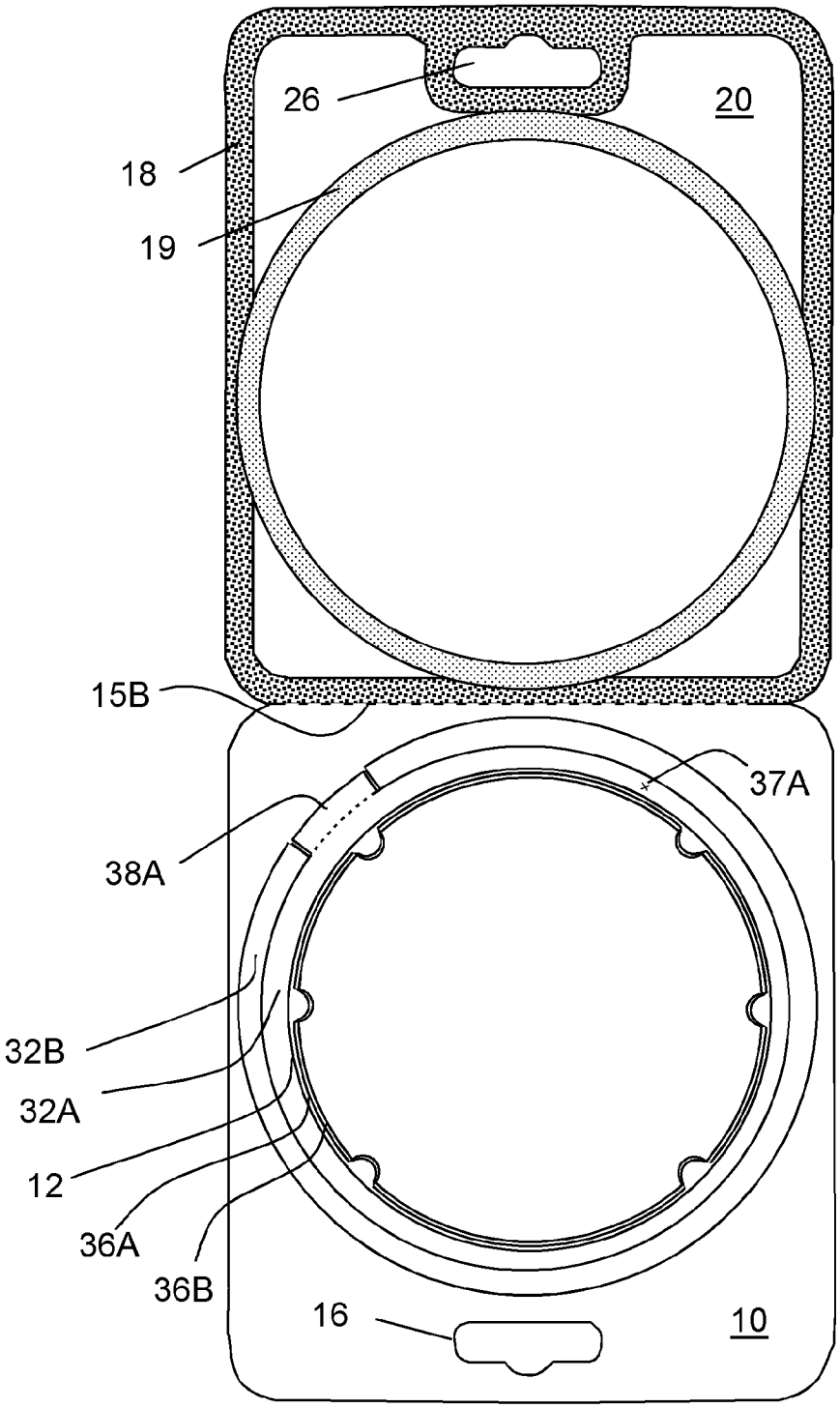
FIG. 7 is a plan view of a glue pattern for assembling the package.

FIG. 7 shows example glue patterns for a package. Although the glue patterns are shown on the back card 20, glue could be applied to either or both cards. This particular example package is formed from a unitary (one piece) blank where front card 10 and back card 20 are joined along fold line 15B (similar to FIG. 2B). Besides showing the blank/cards, FIG. 7 also shows the relative positions of several approximately concentric features, annotated at the lower left of the Figure, from the outermost to the innermost as follows: inner flange 32B of the inner (or bottom) blister, outer flange 32A of the outer (or top) blister, aperture 12 in front card 10, outer blister wall 36A, and inner blister wall 36B. Inner flange 32B is shown with a circular perimeter, but since inner blister 30B does not rotate, inner flange 32B could have a different shape, such as a rectangular perimeter. Outer flange 32A is also shown with a circular perimeter, which in the example of FIG. 7 facilitates rotation of the outer blister. However, outer flange 32A could have a different shape, particularly if inner flange 32B is sealed only to back card 20, and if front card 10/back card 20 have sufficient space around aperture 12 to allow a different shaped outer flange 32A to rotate.

Glue pattern 18 is shown as one of many glue patterns that may be used to seal together the perimeter (and/or other areas) of the front card 10 and back card 20. Likewise glue pattern 19 is one of several glue patterns that may be used to seal, to one or both of the front and back cards, at least portions of the periphery of inner flange 32B that extends outward of outer flange 32A This will hold the inner blister 30B stationary. However, the outer flange 32A itself (except for optional lock tab 38A that may be glued to one or both of the front and back cards) may be substantially free of attachment to either card, and able to be rotated. By "substantially free of attachment" it is meant that the outer flange is either completely free of fixed attachment to either card, or it may be temporarily attached in such a way that the attachment can be freed relatively easily without significant damage to the package, in order to allow the outer flange to rotate. If an optional lock tab 38A is used, it may be secured, for example by gluing, to one or both of the front and back cards. Instead of, or in addition to the lock tab 38A itself being glued, it may be restricted from rotating by adjacent portions of inner flange 32B, which may be attached to the front and/or back card. Various methods may thus be used to interfere with rotation of the lock tab 38A. However, in any case the optional lock tab 38A may be broken loose from the outer flange 32A by application of sufficient turning force on outer blister 32A. The outer blister 32A then becomes free to rotate. More than one optional lock tab 38A may be used.

"Glue" is only one example of how the cards and blister flange may be attached together. Heat sealing, RF sealing, stapling, and other means may also be used.

Optionally, instead of or in addition to lock tab 38A, one or more tack points may be provided such as tack point 37A where outer flange 32A is attached temporarily to one or both cards or to the inner flange 32B to temporarily block movement of outer flange 32A and outer blister 30A. If such tack points are provided, they may be designed to break loose upon moderate force to allow the package to be thereafter open and closed.

It will be noted that the package has multiple layers including two layers over much of the front and back cards, three layers at the outer periphery of inner flange 32B, and four layers including the outer flange 32A. The front card 10 or back card 20 may be embossed to provide extra clearance for one or both flanges. For example front card 10 may be embossed around aperture 12 to provide extra clearance for the thickness of outer flange 32A.

After opening, the package may be reclosed to a configuration suitable for again storing the contents (or other items) in the closed package. If a purchaser returns the package to the retailer, the retailer may be able to place the package back into inventory (for example as discounted "returned/opened goods") since the reclosed structure still has a neat appearance and the package structure is still quite sturdy.

The front card 10 and back card 20 may be formed of a sheet material such as paperboard, which may be made of or coated with materials to increase its strength. An example of such a sheet material is NATRALOCK® paperboard made by MeadWestvaco Corporation. The sheet material may have a heat sealable coating, for example to allow a heat seal to be created between the front card 10 and back card 20. Alternately, other forms of adhesive may be used to seal these cards together. It should be noted that the use of tear resistant materials, and/or in more than one layer, help to improve the tamper- and theft-resistance of the package.

The adjoining surfaces of front card 10 and back card 20 may be adhered together by heat sealing, RF sealing, ultrasonic sealing, gluing, or other adhesive. Back card 20 and front card 10 may, for example, be paperboard. The cards are shown with substantially the same perimeter, which may yield a package comprised of two layers of paperboard. However, portions of the package might only be single ply. One or both cards may comprise hang hole 16, or it may be reinforced with additional layer.

Heat sealing together of the front and back cards may be accomplished by use of both heat and pressure. Heat sealing may be used on inner flange 32B. Heat sealing may also be used along the periphery of front card 10 and back card 20. Alternately heat sealing may be used on the entire adjoining surfaces of front card 10 and back card 20, excepting leaving free the outer flange 32A.

The features described in this application may be used alone or in combination with other package features. It is to be understood that a variety of materials may be used to form these packages. However, for sustainability purposes, a paperboard based material may be used and for improved theft deterrence a tear resistant paperboard may be used. Package materials may include tear-proof materials such as DURAFOLD® paperboard, tear-resistant materials such as NATRALOCK® paperboard, as well as other types of paperboard or plastic materials. The packages may be made of one or more layers of material, including but not limited to one, two, three or more layers of material. Different parts of the packages may comprise different materials and/or different numbers of layers.

The packages disclosed herein may be comprised mostly of paperboard, for example as described in International Application PCT/US08/051245. The paperboard used in such packages may be tear-resistant as described in commonly assigned U.S. Pat. No. 7,144,635.

The packages disclosed herein may be made from one or several blanks (that is, the cut sheet parts from which the package components are made by folding and other steps). However, it should be understood that certain unitary blanks may be provided instead as more than one part, and certain blanks may be combined into single blanks, while still arriving at the same finished package.

Where more than one blank is used, the blanks may be assembled in various stages, including assembling a unitary blank into a package, assembling separate blanks and then joining them to form a package, and joining two or more blanks together, for example by heat sealing, gluing, mechanical fastening, or otherwise and then forming the combined blanks into the package.

It is to be understood that certain packages may be one continuous piece of material, and other packages may comprise two or more pieces of material. It is to be understood that a package may be heat sealed even where a heat sealed surface is in contact with a non-heat sealable surface. It is to be understood that in such a situation such an adhesion will strengthen the package, though it may not strengthen it as much as heat sealing between two heat sealable surfaces.

The packages described herein may be assembled in stages at various locations, for example partially constructing the package, moving or shipping it to one or more other locations, and completing the assembly of the package. For example, a package may be formed into a flattened or collapsible structure, then moved or shipped to another location for final forming, filling, and closure.

Portions of the packages may be made of one, two, or more layers of material. It is to be understood that additional layers of material may be used based on manufacturing preferences. Portions of certain cards may be folded over or around the portions of other cards, creating multiple layers of material.

It should be understood that additional foldover cards may be included in the package blanks for further reinforcing the packages.

Those skilled in the art will appreciate that the disclosed blister packaging structures may provide a theft deterrent function at least for a few moments, while providing legitimate consumers with packages easy to open in a reasonably short time.

To provide additional tear resistance protection, any of the materials used in these designs could be provided with overt or hidden features such as nicks, scores, perforations, holes, or other diverting features such that if a tear is initiated in the packaging material, it will not propagate in a direction more likely to breach the package, but may be rerouted by the diverting feature or features in a direction less likely to breach the package. Alternately the diverting feature may stop the tear, slow the progression of the tear, or cause it to take a meandering path, thus lengthening the time it may take to eventually breach the package, and thereby discouraging a thief. Certain tear-diverting features are described in PCTUS09049536.

It is to be understood that a variety of features may be used on any of these package designs as determined by manufacturing preferences. One or more reinforcing layers of paperboard or other material may be placed between layers of a package, for example between the front and back cards of a card-type package, for example at the hang hole location, as described in PCT/US08/066517. Although various aspects of the disclosed blister packaging structures have been shown and described, modifications may occur to those skilled in the art upon reading the specification.

The invention claimed is:

1. A package comprising:

a first card and a second card comprised of sheet material, the first and second cards at least partly attached together to form a two-ply structure;

an inner blister comprising an inner body portion and an inner blister flange, the inner body portion defining at least one compartment;

an outer blister comprising an outer body portion and an outer blister flange; the outer body portion fitting over the inner body portion, the outer body portion including an opening; and an aperture in the first card to receive both blister body portions with both flanges positioned between the first and second cards and the inner blister flange attached to one or both of the cards;

wherein the outer blister flange is able to rotate in the aperture only after breaking a temporary attachment to at least one of the first card, second card, or inner blister flange;

wherein the temporary attachment is a lock tab extending radially outward from the outer blister flange, the lock tab being attached to at least one of the first card, second card, or inner blister flange; and wherein after the temporary attachment is broken, the outer blister is able to rotate in the aperture to align the opening with the at least one compartment.

2. The package of claim 1, further comprising at least one detent in each of the inner body portion and outer body portion, wherein the detents engage to pause rotation of the outer blister in at least one position.

3. The package of claim 2, wherein the inner body portion comprises multiple compartments and the detents engage to pause rotation at each of the compartments.

4. The package of claim 1, wherein the inner body portion comprises a stop feature that fits into the opening when the package is in a closed position.

5. The package of claim 1, wherein at least one of the cards comprises a tear-resistant paper or paperboard.

6. The package of claim 1, wherein the inner blister and outer blister each comprises RPET or PLA.

7. The package of claim 1, wherein the aperture is circular.

8. The package of claim 1, wherein the blisters are approximately circular cylinders.

9. The package of claim 1, wherein the outer blister fits closely within the aperture.

10. A method of forming a package, the method comprising:

providing a first card comprised of sheet material and having an aperture therein;

providing a second card comprised of sheet material;

providing an inner blister comprising an inner body portion and an inner blister flange, the inner body portion defining at least one compartment;

providing an outer blister comprising an outer body portion and an outer blister flange; the outer body portion including an opening, the outer body portion fitting over the inner body portion, the outer blister flange having a lesser diameter than inner blister flange diameter;

placing the outer blister over the inner blister;

placing the combined outer blister and inner blister so that their respective body portions protrude through the aperture;

bringing the first and second cards together with the inner and outer blister flanges between the cards, and fastening the first and second cards together so that the inner blister flange is held stationary between the cards and the outer blister flange is substantially free of fixed attachment to the cards except for temporary attachment in the form of a lock tab extending radially outward from the outer blister flange and temporarily attached to at least one of the first card, second card, or inner blister flange;

wherein the outer blister flange is able to rotate in the aperture only after breaking the temporary attachment.

11. A package comprising:

a first card and a second card comprised of sheet material, the first and second cards at least partly attached together to form a two-ply structure;

an inner blister comprising an inner body portion and an inner blister flange, the inner body portion defining at least one compartment;

an outer blister comprising an outer body portion and an outer blister flange; the outer body portion fitting over the inner body portion, the outer body portion including an opening; and an aperture in the first card to receive both blister body portions with both flanges positioned between the first and second cards and the inner blister flange attached to one or both of the cards;

wherein the outer blister flange is able to rotate in the aperture only after breaking a temporary attachment to at least one of the first card, second card, or inner blister flange; and wherein the temporary attachment is a lock tab extending radially outward from the outer blister flange, the lock tab being attached to at least one of the first card, second card, or inner blister flange.

12. The package of claim 11, wherein the lock tab is separated from the outer blister flange by the application of a twisting motion to the outer blister.

13. The package of claim 11, wherein the lock tab is received in a notch in the inner blister flange.

14. The package of claim 11, wherein the inner blister flange extends radially outward further than the outer blister flange, the inner blister flange being substantially sealed to at least one of the cards, and the outer blister flange being substantially not sealed to the cards.

15. The package of claim 11, wherein the outer blister flange has a thickness, and the first card is embossed around the aperture to provide clearance for the thickness of the outer blister flange.

16. The package of claim 11, wherein the outer blister can only be rotated after applying sufficient torque to break loose an adhesive or heat seal tack point attachment between the outer blister flange and at least one of the first card, second card, and inner blister flange.

17. The package of claim 11, wherein the outer blister is able to rotate in the aperture to align the opening with the at least one compartment.

18. The package of claim 11, further comprising at least one detent in each of the inner body portion and outer body portion, wherein the detents engage to pause rotation of the outer blister in at least one position.

19. The package of claim 18, wherein the inner body portion comprises multiple compartments and the detents engage to pause rotation at each of the compartments.

* * * * *